US011100905B1

(12) United States Patent
Swartz

(10) Patent No.: US 11,100,905 B1
(45) Date of Patent: Aug. 24, 2021

(54) TREMOLO DEVICE

(71) Applicant: Daniel Swartz, Spokane, WA (US)

(72) Inventor: Daniel Swartz, Spokane, WA (US)

( * ) Notice: Subject to any disclaimer, the term of this patent is extended or adjusted under 35 U.S.C. 154(b) by 0 days.

(21) Appl. No.: 17/075,537

(22) Filed: Oct. 20, 2020

(51) Int. Cl.

| | |
|---|---|
| ***G10D 3/153*** | (2020.01) |
| ***G10D 3/04*** | (2020.01) |
| ***G10D 3/12*** | (2020.01) |
| ***G10D 1/08*** | (2006.01) |

(52) U.S. Cl.
CPC ..... *G10D 3/153* (2020.02); *G10D 1/085* (2013.01); *G10D 3/04* (2013.01); *G10D 3/12* (2013.01)

(58) Field of Classification Search
CPC ..... G10D 3/153; G10D 1/085; G10D 3/04; G10D 3/12
See application file for complete search history.

(56) References Cited

U.S. PATENT DOCUMENTS

| | | | |
|---|---|---|---|
| 319,188 | A | 6/1885 | Brinsmead |
| 542,719 | A | 7/1895 | Wahner |
| 1,899,395 | A | 1/1932 | Kauffman |
| 1,926,661 | A | 9/1933 | Schrickel |
| 2,070,916 | A | 8/1935 | Peate |
| 2,073,226 | A | 3/1937 | Schnickel |
| 2,130,248 | A | 9/1938 | Peate |
| 2,201,889 | A | 5/1940 | Nickel, Jr. |
| 2,241,911 | A | 5/1941 | Kauffman |
| 2,323,969 | A | 7/1943 | Biederman |
| D170,109 | S | 8/1953 | Bigsby |
| 2,741,146 | A | 4/1956 | Fender |
| 2,781,685 | A | 2/1957 | White et al. |
| 2,802,386 | A | 8/1957 | Crosby |
| 2,972,923 | A | 2/1961 | Fender |
| 3,014,395 | A | 12/1961 | Blair |
| 3,124,991 | A | 3/1964 | Costen |
| 3,162,083 | A | 12/1964 | Webster |
| 3,181,409 | A | 5/1965 | Burns et al. |
| 3,248,991 | A | 5/1966 | Cole |
| 3,411,394 | A | 11/1968 | Jones |
| 3,466,962 | A | 9/1969 | Cole |
| 3,971,286 | A | 7/1976 | Borell |
| 4,100,832 | A | 7/1978 | Peterson |
| 4,171,661 | A | 10/1979 | Rose |

(Continued)

OTHER PUBLICATIONS

US 5,551,229 A, 09/1996, Iovane (withdrawn)

*Primary Examiner* — Kimberly R Lockett
(74) *Attorney, Agent, or Firm* — Keith D. Grzelak; Wells St. John P.S.

(57) ABSTRACT

A tremolo apparatus is provided having a stationary frame, a moving frame, at least one linear guideway, a string retainer, and at least one spring. The stationary frame is configured to be affixed to a planar surface of a stringed instrument. The moving frame has at least one ramp with a flat segment and is guided for oscillation relative to the stationary frame. The at least one linear guideway is provided by the stationary frame or the moving frame and supports the moving frame for oscillation. The string retainer has a plurality of string capture bores and engages with the ramp surface to carry a plurality of strings reciprocally as the string bar rides the ramp surface and reciprocates to alter tension of the strings carried terminally of the string retainer. The at least one spring is interposed between the frames to position the string retainer within the flat segment.

23 Claims, 9 Drawing Sheets

(56) References Cited

U.S. PATENT DOCUMENTS 4,285,262 A 8/1981 Scholz
4,343,220 A 8/1982 Lundquist
4,383,466 A 5/1983 Shibuya
4,457,201 A 7/1984 Storey
4,487,100 A 12/1984 Storey
4,512,232 A 4/1985 Schaller
4,555,970 A 12/1985 Rose
4,563,934 A 1/1986 Keizer
4,572,049 A 2/1986 Tanaka et al.
4,608,906 A 9/1986 Takabayashi
4,610,190 A 9/1986 Maloney
4,632,004 A 12/1986 Steinberger
4,632,005 A 12/1986 Steinberger
4,643,070 A 2/1987 Petrillo
4,648,304 A 3/1987 Hoshino
4,656,915 A 4/1987 Osuga
4,671,157 A 6/1987 Fender
4,674,389 A 6/1987 Fender
4,677,891 A 7/1987 Gressett et al.
4,681,010 A 7/1987 Wilkinson
4,681,011 A 7/1987 Hoshino
4,686,883 A 8/1987 Piche et al.
4,692,079 A 9/1987 Killian et al.
4,697,493 A 10/1987 Ralston
4,704,936 A 11/1987 Steinberger
4,709,612 A 12/1987 Wilkinson
4,724,737 A 2/1988 Fender
4,742,750 A 5/1988 Storey
4,763,555 A 8/1988 Minakuchi
4,768,415 A 9/1988 Gressett, Jr. et al.
4,782,732 A 11/1988 Kato
4,892,025 A 1/1990 Steinberger
4,903,568 A 2/1990 Itoh
4,967,631 A 11/1990 Rose
5,088,375 A 2/1992 Saijo
5,305,675 A 4/1994 Lasner
5,359,144 A 10/1994 Benson
5,373,769 A 12/1994 Sherman
5,381,716 A 1/1995 May
5,392,680 A 2/1995 Stets
5,413,019 A 5/1995 Blanda, Jr.
5,419,227 A 5/1995 Lavineway
5,429,028 A 7/1995 Fisher, IV
5,431,079 A 7/1995 Bunker
5,435,219 A 7/1995 Huff
5,477,765 A 12/1995 Dietzman
5,481,955 A 1/1996 Goto
5,520,082 A 5/1996 Armstrong
5,522,297 A 6/1996 Enserink
5,539,144 A 7/1996 Sherman
5,602,352 A 2/1997 Huff
5,631,435 A 5/1997 Hutmacher
5,637,818 A 6/1997 Fishman et al.
5,672,835 A 9/1997 Doughty
5,708,225 A 1/1998 Sherman
5,747,713 A 5/1998 Clement
5,783,763 A 7/1998 Schaller
5,808,216 A 9/1998 Fisher, IV
5,824,925 A 10/1998 Yost
5,907,114 A 5/1999 Culver
5,939,653 A 8/1999 Chang
5,959,224 A 9/1999 McCune
5,965,831 A 10/1999 McCabe
5,986,190 A 11/1999 Wolff
5,986,192 A 11/1999 Wingfield
6,015,945 A 1/2000 Borisoff
6,084,166 A 7/2000 Lee
6,087,570 A 7/2000 Sherlock
6,100,459 A 8/2000 Yost
6,118,057 A 9/2000 Chang
6,143,967 A 11/2000 Smith et al.
6,175,066 B1 1/2001 McCabe
6,194,645 B1 2/2001 Rose
6,300,550 B1 10/2001 Smith
6,384,311 B1 5/2002 Cota
6,420,639 B1 7/2002 Sherlock
6,563,034 B2 5/2003 McCabe
6,573,439 B2 6/2003 Wilson
6,686,524 B2 2/2004 Hirayama
6,875,911 B2 4/2005 Schryer
6,881,882 B2 4/2005 Ito et al.
6,989,483 B2 1/2006 Ramsay
7,009,096 B2 3/2006 Hirayama
7,045,693 B2 5/2006 Rose et al.
7,053,287 B2 5/2006 Dam
7,071,398 B2 7/2006 Hannes
7,189,908 B2 3/2007 Lavineway
7,259,309 B1 8/2007 Lovelace
7,339,102 B2 3/2008 Folmar et al.
7,459,619 B2 12/2008 Gawenda
7,470,841 B1 12/2008 McCabe
7,479,592 B1 1/2009 Slavik
7,521,616 B2 4/2009 Kahler
7,534,950 B2 5/2009 Lyles
7,541,528 B2 6/2009 Lyles
7,592,528 B2 9/2009 Lyles et al.
7,696,420 B2 4/2010 Thompson
7,718,873 B1 5/2010 Slavik
7,772,470 B1 8/2010 Olsen
7,820,898 B2 10/2010 Bayliss
7,829,773 B2 11/2010 Shamblin
7,838,751 B2 11/2010 Hendricks
7,855,330 B2 12/2010 Lyles et al.
7,888,571 B2 2/2011 Steinberger
7,935,876 B1 5/2011 West
7,960,630 B2 6/2011 Steinberger
7,973,226 B2 7/2011 Towner
8,017,844 B2 9/2011 Steinberger
8,163,987 B1 4/2012 Dennis
8,173,882 B2 5/2012 Hannapel
8,252,999 B2 8/2012 Deck
8,314,317 B2 11/2012 Hendricks
8,389,836 B2 3/2013 Uberbacher
8,536,431 B1 9/2013 McCabe et al.
8,546,670 B2 10/2013 Finkle
8,609,965 B2 12/2013 Hendricks
8,678,659 B2 3/2014 Miller et al.
8,697,969 B2 4/2014 Van Ekstrom
8,748,717 B2 6/2014 Mason
8,779,258 B2 7/2014 Lyles et al.
8,779,259 B1 7/2014 Herrmann
8,796,524 B1 8/2014 Deck
8,853,513 B2 10/2014 Kernick
8,907,188 B2 12/2014 Hendricks
8,940,986 B1 1/2015 Edwards
8,946,529 B2 2/2015 Rose
9,076,412 B1 7/2015 Rolling
9,171,529 B2 10/2015 Rukavina
9,183,815 B2 11/2015 Finkle
9,196,232 B2 11/2015 Borisoff
9,236,036 B2 1/2016 Finkle
9,299,324 B2 3/2016 Van Ekstrom
9,299,325 B1 3/2016 Brickwell
9,299,326 B1 3/2016 Tomczak
9,318,081 B2 4/2016 Lyles
9,330,638 B2 5/2016 Maslarov
9,355,623 B2 5/2016 Thidell
9,466,270 B2 10/2016 Hendricks
9,502,009 B1 11/2016 Anderson
9,502,010 B1 11/2016 Cardozo
9,613,600 B2 4/2017 Lyles
9,691,364 B1 6/2017 McCabe
9,697,809 B2 7/2017 Cardozo
9,767,771 B2 9/2017 Marttila
9,792,886 B2 10/2017 Lee et al.
9,799,307 B1 10/2017 Minasi
9,812,099 B1 11/2017 Nackard
9,816,382 B2 11/2017 Maurizio
9,892,717 B2 2/2018 Finkle
9,899,008 B1 2/2018 Williams
9,916,819 B2 3/2018 Finkle
9,922,625 B2 3/2018 Tracy
9,922,632 B1 3/2018 Craig
9,934,762 B1 4/2018 Jackson

(56) References Cited

U.S. PATENT DOCUMENTS

| | | | | |
|---|---|---|---|---|
| 9,990,907 | B2 | 6/2018 | McKenzie | |
| 10,019,972 | B2 | 7/2018 | Poschelk | |
| 10,140,964 | B2 | 11/2018 | Cardozo | |
| 10,224,009 | B2 | 3/2019 | Lyles | |
| 2008/0229898 | A1* | 9/2008 | Steinberger ..... | G10D 3/153 84/298 |
| 2017/0178603 | A1 | 6/2017 | Poschelk | |
| 2017/0301323 | A1 | 10/2017 | Cardozo | |

* cited by examiner 40
45
61
42
44
44
43
63
38
47
65

132
136
36
130
122
134
51

44
40
42
43
8
38
47
38
128
126
124
136
140
142
53
122
7
53
138
50
142
51
37
140
36
46
22

TREMOLO DEVICE

TECHNICAL FIELD

This disclosure pertains to stringed musical instruments having a pitch shifting mechanism. More particularly, this disclosure relates to a tremolo device and an adjustable bridge.

BACKGROUND

Techniques are known for redirecting the strings on stringed instruments and for pitch shifting by varying string tension. Traditional floating tremolo units, the activation of which may result in a pitch shift up or down of a number of vibrating strings, and which act as both the bridge and tremolo unit, use springs to counteract the tension exerted on the tremolo and bridge unit by the strings. These tremolo units have the fundamental flaw of requiring re-balancing whenever the player changes tunings, changes string gauges, or breaks a string.

Instruments without a tremolo unit (hardtail) have immobile bridge units, with strings anchored in the bridge or inside the body of the instrument. These instruments do not have instantaneous pitch altering capabilities like those with tremolo units, but do have the advantage of remaining generally consistent across tuning and string gauge changes and string breakage incidents.

A Bigsby tremolo system (U.S. Pat. No. D170,109) utilizes a stationary bridge unit with a separate rotating cylinder onto which the strings are mounted. The tremolo arm is supported by a spring, which counters the rotational force induced by the tension of the strings. This has advantages in some aspects over floating tremolos, such as ease of setup and stability across tuning changes initiated at the tuning pegs, but lacks the versatility, scope of pitch shift, and tuning stability present in other systems.

There exists a need for a tremolo system that improves pitch shifting, tuning stability, and ease of setup which allows for pitch shifting both up and down, and provides a consistency of tuning before and after tremolo activation, provides for a consistent pitch of the remaining strings when the pitch of any given string is altered by tuning machines, and provides an ease of setup and maintenance.

SUMMARY OF THE INVENTION

A tremolo device and an accompanying adjustable string guide and bridge assembly are provided for use on any stringed musical instrument, such as electric guitars and basses. The tremolo device is configured to alter the pitch of the strings by changing the tension exerted on said strings in a manner that optimizes desirable tonal qualities into the structures of the stringed instrument, such as a soundboard.

According to one aspect, a tremolo apparatus is provided having a stationary frame, a moving frame, at least one linear guideway, a string retainer bar, and at least one spring. The stationary frame is configured to be rigidly affixed to a planar surface of a resonant body on a stringed instrument. The moving frame has at least one ramp with a medial flat segment, and the moving frame is guided for oscillation relative to the stationary frame. The at least one linear guideway extends substantially parallel to the planar surface and is provided by at least one of the stationary frame and the moving frame and is configured to support the moving frame for oscillation. The string retainer bar has a plurality of string capture bores carried by the guide frame for movement toward and away from the planar surface and configured to engage with the ramp surface to carry a plurality of strings substantially perpendicular with the planar surface to vary string tension as the string mounting assembly rides the ramp surface and reciprocates to respectively raise and lower tension of a plurality of strings carried terminally of the string mounting assembly. The at least one spring is interposed between the stationary frame and the moving frame to position the string bar within the medial flat segment.

According to another aspect, a tremolo apparatus is provided having a stationary frame, a moving frame, a track, a string retainer, and at least one spring. The stationary frame is configured to be rigidly affixed to a planar surface of a resonant body on a stringed instrument. The moving frame has at least one ramp with a medial flat segment, and the moving frame is guided for reciprocation relative to the stationary frame. The track extends substantially parallel to the planar surface and is provided by at least one of the stationary frame and the moving frame and is configured to support the moving frame for reciprocation relative to the stationary frame. The string retainer bar is configured to carry a plurality of strings on the guide frame for movement toward and away from the planar surface and configured to engage with the ramp surface to carry a plurality of strings substantially perpendicular with the planar surface to vary string tension as the string mounting assembly rides the ramp surface responsive to reciprocation to respectively raise and lower tension of a plurality of strings carried terminally of the string mounting assembly. The at least one spring is interposed between the stationary frame and the moving frame to position the string bar within the medial flat segment.

According to yet another aspect, a tremolo apparatus is provided having a moving frame, a stationary frame, an actuator arm, a string retainer bar, and a resilient elongated member. The moving frame has at least one ramp surface with a flat medial portion. The stationary frame is carried by a mounting surface of a stringed instrument body and is configured to support the moving frame for oscillation in substantially perpendicular relation with the direction of string tension. The actuator arm is coupled with the moving frame and is carried by the stationary frame configured to drive the moving frame in oscillation with the stationary frame. The string retainer bar is provided by the stationary frame and is configured to provide oscillatory movement of at least one string along the direction of string tension, the moving frame configured to be driven in oscillation by a user relative to the stationary frame to respectively raise and lower tension of the at least one string affixed to the string retainer bar as the string retainer bar rides the ramp surface. The resilient elongated member is configured to position the flat medial portion of the ramp surface against the string retainer bar when in a resting state.

DETAILED DESCRIPTION OF THE ILLUSTRATED EMBODIMENTS

Figure 1:
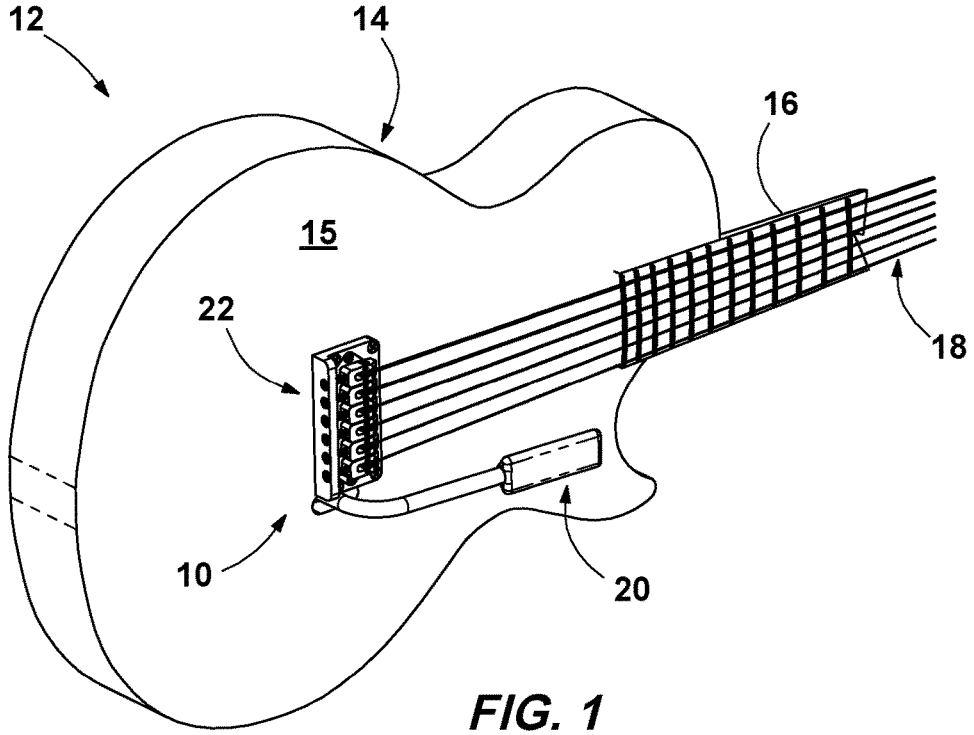
FIG. 1. Is a perspective view from above and in front of a guitar having a tremolo assembly and adjustable bridge according to one aspect.

This disclosure is submitted in furtherance of the constitutional purposes of the U.S. Patent Laws "to promote the progress of science and useful arts" (Article 1, Section 8).

A common feature on modern stringed musical instruments (though primarily fitted to electric guitars and basses) is the tremolo device. The purpose of the tremolo device is to alter the pitch of the strings by changing the tension exerted on the strings. Traditional tremolo devices mount to the top of the instrument via a number of different mechanisms, and alter the tension of the strings via rotation around a fixed point. These tremolo devices counter the tension of the strings via tension provided by springs mounted into the back of the instrument or directly to the tremolo device. The springs typically need to be adjusted so that they provide a tension equal to the combined tension of all of the strings at their designated individual pitches. This method has a side-effect of overcompensating for any changes to tuning initiated by the tuning posts at the nut end of the instrument and causing undesired pitch alterations. For example, if one decreases the tension, and thus the pitch, of a single string then the tension and pitch of the remaining strings increases to match the constant tension provided by the springs, causing the remaining strings to go out of tune.

In view of such inherent design inadequacies, the present tremolo apparatus is mounted inside the body of the instrument underneath the bridge mechanism. This design does not rely on the rotation of the bridge and the direct action of the balancing springs, but instead on the translational motion of the aforementioned sled and ramp system. As the sled is moved back and forth by the interaction of the tremolo arm, gears, and toothed track, the strings are stretched or slackened by the variation of the shape of the ramp in the direction of string tension over the course of its length. Modern stringed-instrument strings are constructed such that one end of the string is secured by a ball-end. The ball end of the string is retained in the string-mounting apparatus of my invention. The string mounting apparatus is constantly supported by the ramp, which isolates the effect of spring tension, as it serves only to return the sled, ramp, and strings to their pre-activation position and tension instead of directly countering string tension. Through the ramp, the force of the strings is transferred to the body by way of the sled, the gears, and the base framework apparatus, similar to the way in which the strings are supported in an instrument with a hardtail bridge. The friction on the ramp is reduced by the bearings which translate the force of the strings onto the ramp. The shape of the ramp, and the mounted return springs mean that whenever the device is not activated, the ramp, and thus the strings, return to the original (pre-activation) position and tension regardless of string tuning. Having a constant resting position to return to, and relying on the support of the body means that any tuning changes initiated at the nut end of the instrument do not affect the tuning of the other strings. This means that the guitar has the ease of use, tuning flexibility, and tuning stability of a hardtail system and the full functionality of a tremolo system.

FIG. 1 is a partial perspective view from above of an electric guitar 12 having a new tremolo assembly 10, according to one aspect. Tremolo 10 is mounted within a body 14 of guitar 12, beneath an adjustable bridge 22 that is affixed to a top surface 15 of body 14. According to one construction, six unique strings 18 extend along a neck 16 of guitar 12 along a front surface 15 of body 14 from a distal tuning end (not shown) to a proximal end at adjustable bridge 22 where they each terminate within tremolo assembly 10. Optionally, any of a number of strings can be provided on a stringed instrument using such new tremolo assembly and adjustable bridge. A whammy bar 20 is provided on tremolo assembly 10 configured to enable a user of guitar 12 to vary tension of strings 18 by oscillating frame 26 relative to frame 24. In one case, frame 26 reciprocates in linear motion relative to frame 24 in a substantially parallel plane to a mounting surface (or soundboard) on a stringed instrument. In another case, a moving frame can rotate relative to a stationary frame in order to impart reciprocation between such frames in order to impart a string tensioning and relaxing responsive to movement of an activation arm or whammy bar. Further optionally, any alternative form of reciprocating motion that imparts variation in string tension is envisioned.

Figure 2:
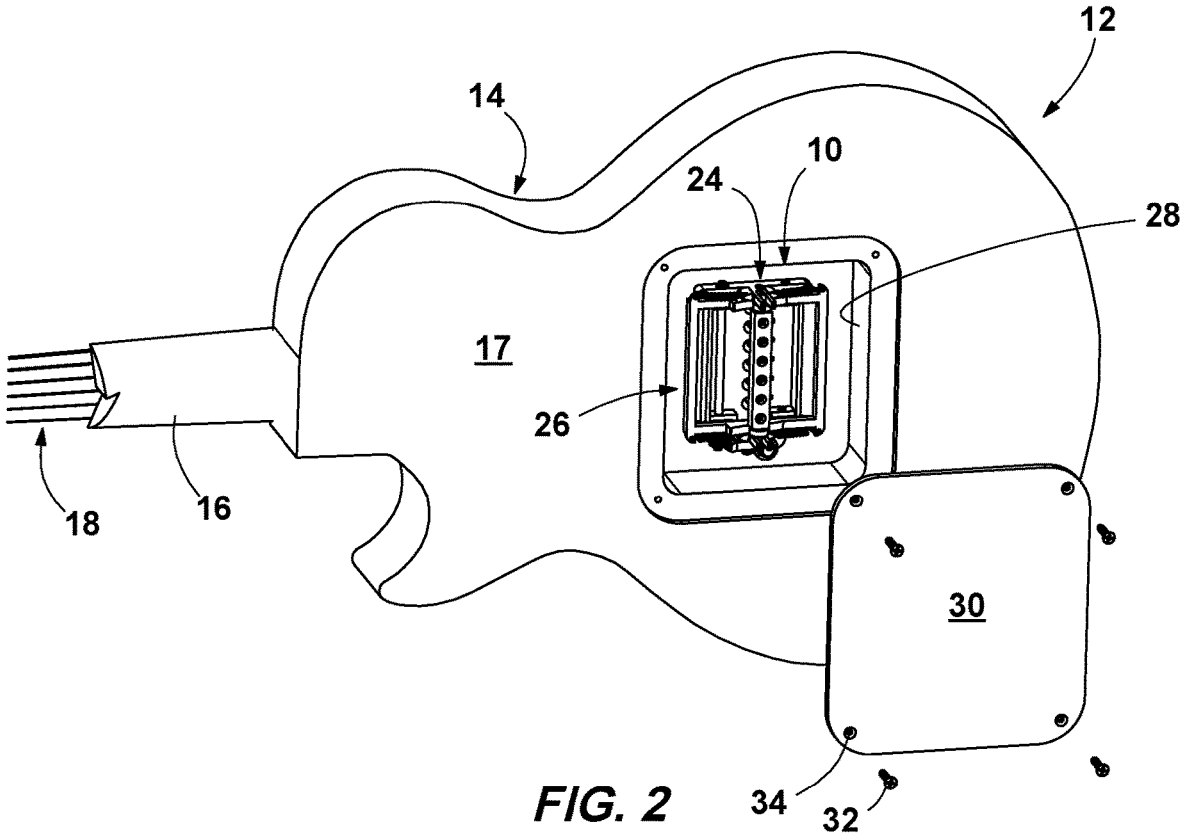
FIG. 2. Is a perspective view from above and behind of the guitar of FIG. 1 with a rear cover removed to show the tremolo assembly affixed to the guitar body.

As shown in FIG. 2, body 14 of guitar 12 has a cover 30 removably received over a recess 28 in a back surface 17 of body 14 via a rectangular array of recessed bores 34 and threaded fasteners, or screws 32. Tremolo assembly 10 is mounted in recess 28 including a base frame 24 and a sled 26. Strings 18 extend along neck 16 toward adjustable bridge 22 on a front surface 15 of body 14 where they pass over rollers 40 and 126 through body 14 for termination at tremolo assembly 10 within body 14. In this manner, tremolo assembly 10 is hidden beneath smooth back surface 17 formed between body 14 and cover 30 where it is accessible via removable cover 30.

Figure 3:
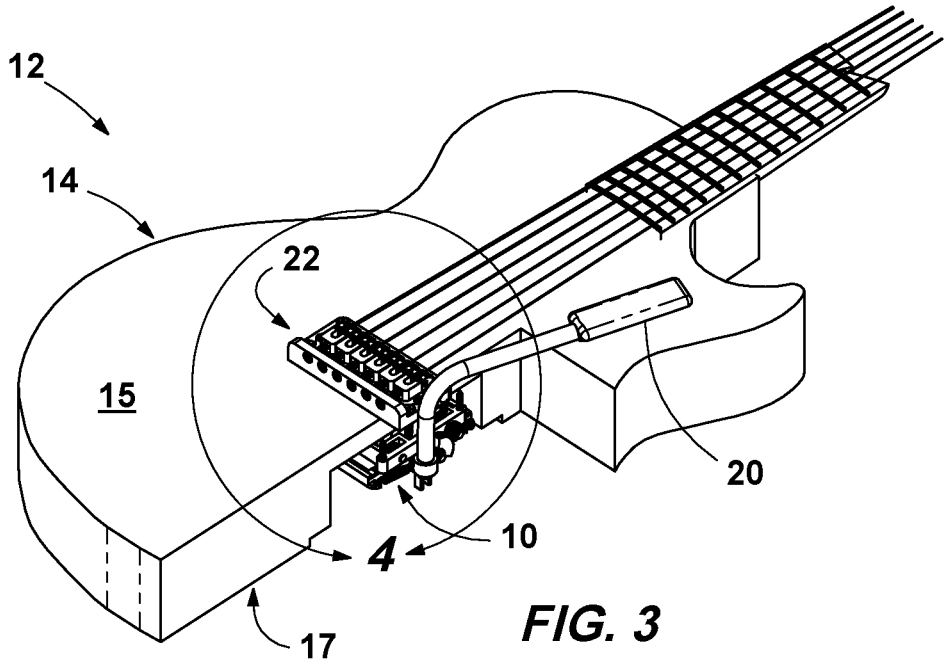
FIG. 3 is a front perspective view with portions removed of the guitar of FIGS. 1 and 2 showing the tremolo assembly and adjustable mounting bridge affixed to the guitar body.

As shown in FIG. 3, tremolo assembly 10 is activated by a user to vary string tension via whammy bar 20 from a front surface of guitar 12 while in use. Adjustable bridge 22 is mounted to top surface 15 of body 14 above tremolo assembly 10 in spaced-apart relation.

Figure 4:
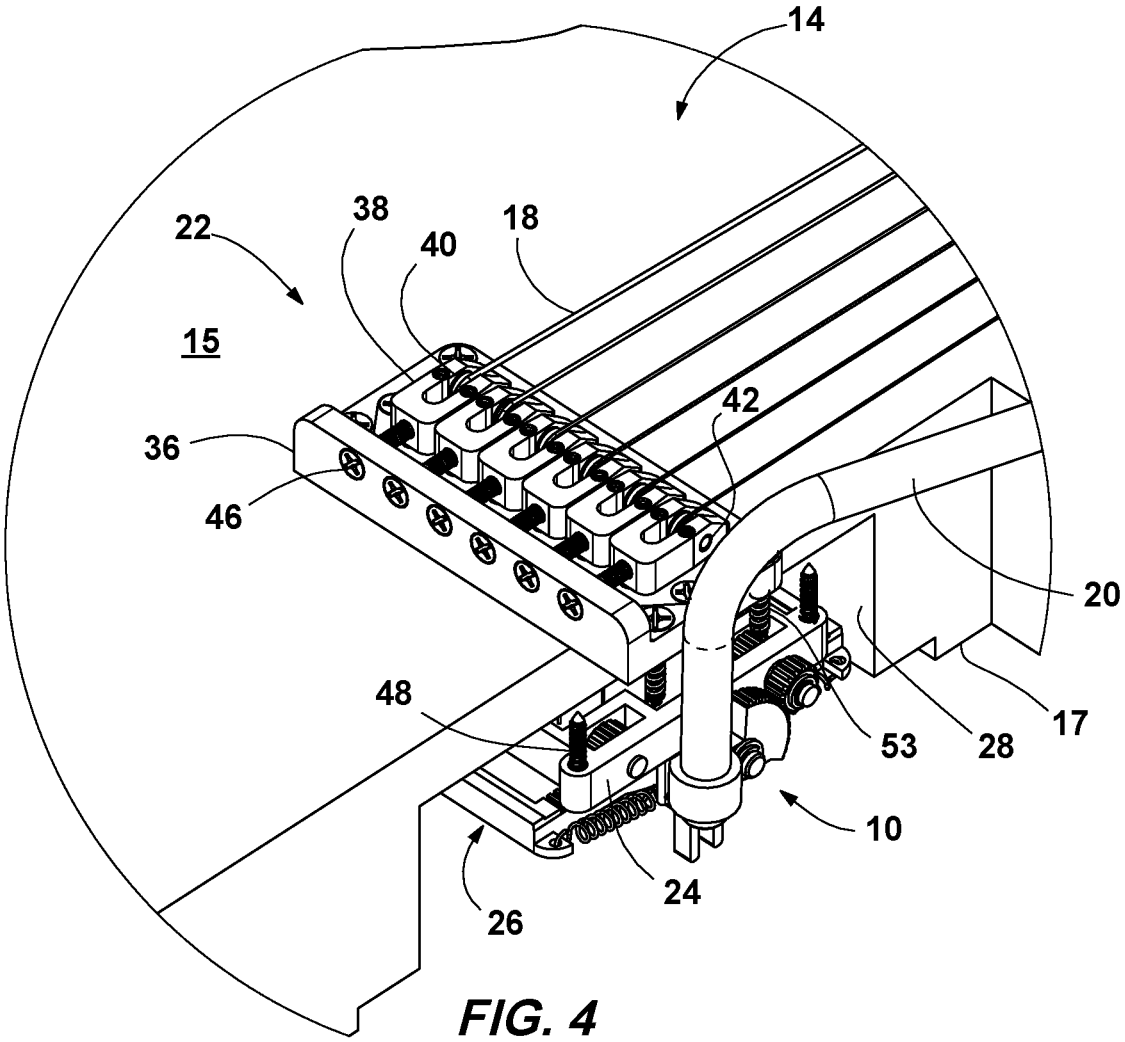
FIG. 4 is an enlarged view of the tremolo assembly and adjustable bridge taken from the encircled region 4 of FIG. 3.

FIG. 4 illustrates in greater detail in partial cutaway view the relationship of tremolo assembly 10 and adjustable bridge 22 relative to body 14 when assembled together. Bridge 22 is affixed atop top surface 15 of body 14 and tremolo assembly 10 is affixed within a recess 28 in bottom surface 17 of body 14. An array of individual yokes or saddles 38 on bridge 22 each carry for rotation a respective roller 40 that guides a respective string 18 downwardly where a terminal end secures to tremolo assembly 10. Each roller 40 is carried for rotation by a cylindrical pin 42 secured in each yoke 38. An L-shaped bracket frame 36 supports the plurality of yokes 38 each adjustable in a horizontal direction parallel to top surface 15 of body 14 via individual threaded adjustment screws 46 configured to enable adjustable positioning of each yoke 38 in the direction of each string 18. A plurality of threaded screws 53 secure frame 36 to top surface 15 of body 14.

As shown in FIG. 4, tremolo assembly 10 is affixed via a base frame 24 with a plurality of screws 48 within recess 28 into body 14. Base frame 24 retains a moving sled, or motion frame 26 for reciprocation perpendicular to the direction of strings 18 at their terminus which varies tension on strings 18 to impart desirable string tension variation while playing the instrument. Movement of a whammy bar 20 imparts reciprocation of sled 26 during use which varies string tension and imparts desirable pitch shifting to vibrating strings.

Figure 5:
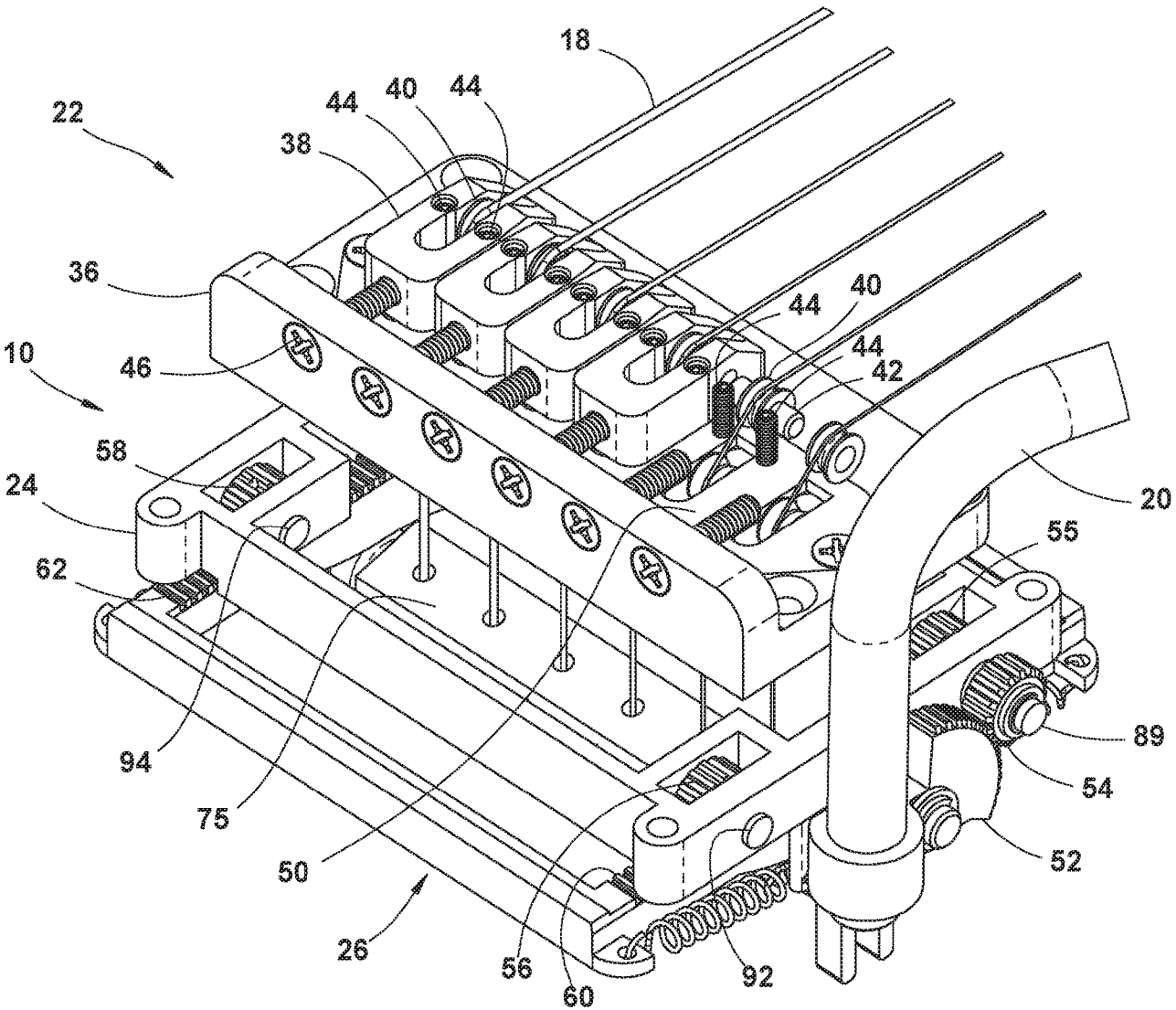
FIG. 5 is an enlarged perspective view of the tremolo assembly and adjustable bridge as assembled together onto a guitar, but with the guitar omitted for clarity.

FIG. 5 illustrates with portions removed the arrangement of tremolo assembly 10 and adjustable bridge 22 as assembled together onto a body of a guitar, but with the body omitted for clarity. Each string 18 passes over a grooved roller 40 held for rotation by a cylindrical press-fit pin 42 with a respective yoke 38 spanning a slot provided between two arms of the yoke 38 in order to alleviate friction on strings 18 and avoid the windings of said strings catching and causing strings 18 to settle at an undesired tension. String 18 drops from roller 40 to another roller 126 where it is directed to terminate at string bar 75. A pair of threaded male set screws are threaded into complementary threaded bores 45 (see FIG. 8) configured to abut against a top surface 50 on frame member 36 to adjust vertical positioning of each yoke 38 and roller 40 in order to adjust and custom tailor string height over a guitar body. Another set of threaded male set screws 46 are received into complementary threaded bores 47 see FIG. 8) in each yoke 38 while passing through a cylindrical bore 51 in L-shaped frame member 36 provided to adjust axial positioning of each yoke 38 in order to minutely adjust the total length of each vibrating string 18 to accommodate differences in length such as when changing string diameter from one set of strings to another set of strings (intonation).

As shown in FIG. 5, base frame 24 of tremolo assembly 10 is rigidly affixed to a guitar body (not shown) while sled 26 is reciprocated relative to base frame 24 via pivotal actuation of whammy bar 20 by a user of a guitar via cam gear 52 co-acting with rotary gear 54 to rotate coupled gear 55 which rides on linear gear rack 60. Follower gear 56 further guides reciprocation of sled 26 along base frame 24. Likewise, another pair of follower gears 57 (see FIG. 9) and 58 guide sled 26 for reciprocation relative to base frame 24 along linear gear rack 62. A common drive shaft 88 carries rotary gears 54, 55 and 57 (see FIG. 9) fixed onto shaft 89 in rotatable relation. Follower rotary gears 56 and 58 are affixed in rotatable relation onto pins, or shafts 92 and 94, respectively.

Ideally, at each point at which the string 18 (of FIG. 5) makes contact with the instrument between the string restraining device, or string bar 75 and the tuning peg, a roller or other friction reducing device, such as rollers 40 and 126, should be employed to decrease the possibility of the winds of the string 18 catching and causing the string to settle at a different tension than desired after tremolo activation.

According to one construction, whammy bar 20 is made of steel tubing, frame 24 is made of brass, frame 26 is made of steel, frame 36 is made of brass, yokes 38 are made of steel, and rollers 40 are made of brass. Other remaining structural components of tremolo assembly 10 and adjustable bridge 22 can be made using any suitable structural material, such as steel, brass, aluminum, metal, composite, plastic, or other suitable structural materials. Optionally, previously enumerated components can also be made of any such suitable structural materials. Selection of materials, for example, brass versus steel can impart certain attributes to tonal quality from vibration transfer through associated structures of a stringed instrument, and vice versa.

Figures 6, 7, 8:
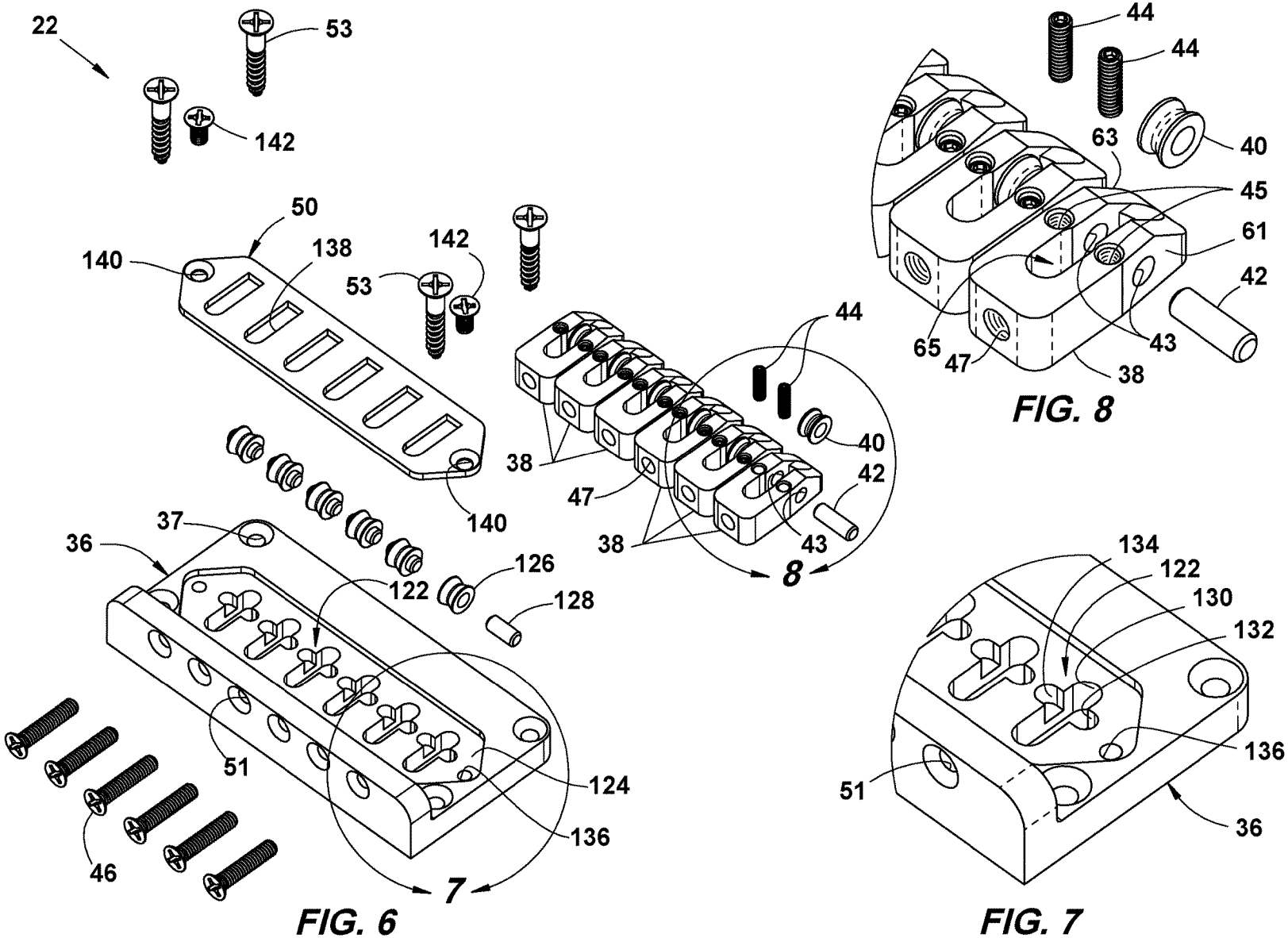
FIG. 6 is an exploded perspective view from above of the adjustable bridge of FIGS. 1-5.
FIG. 7 is an enlarged partial perspective view of the frame for the adjustable bridge taken from the encircled region 7 of FIG. 6.
FIG. 8 is an enlarged partial perspective view of the yoke assemblies for the adjustable bridge taken from the encircled region 8 of FIG. 6.

FIG. 6 illustrates in exploded perspective view from above construction of adjustable bridge 22. More particularly, bridge 22 includes a rigid L-shaped frame 36, a roller retainer plate 50, a plurality of rollers 126 and a plurality of yokes 38. Individual guide rollers 126 are mounted for rotation on individual roller pins 128 and received within individual T-shaped recesses in frame 36. Cover plate 50 is then received in a complementary cover plate recess 124 in plate 36 to entrap rollers 126 for rotation. Each roller is aligned in assembly for rotation within and beneath a respective rectangular slot 138 in plate 50 in assembly. Plate 50 includes a pair of recessed bores 140 configured to receive recessed head threaded fasteners 142 at each end to secure in assembly plate 50 within recess 124. Each screw 142 is threaded into complementary engagement within a respective threaded bore 136 formed within plate 36. A rectangular array of countersunk bores 37 in plate 36 receive countersunk head screws 53 to hold each corner of plate 36 onto a guitar body 14 (see FIG. 4). A plurality of equally spaced-apart recessed bores 51 are provided in a vertical flange of plate 36 configured to each receive a respective one of a plurality of recessed head threaded fasteners 46. Bores 51 each form a clearance bore over the thread of fasteners 46 as distal ends of each fastener 46 are threaded into an end of a respective threaded bore 47 provided in each yoke 38. In this manner, the horizontal position of each yoke and roller 40 can be adjusted. Furthermore, a pair of threaded set screws 44 are received in threaded bores on either side of each yoke 38 configured to enable vertical adjustment of each yoke relative to plate 36. Each roller 40 is received for rotation about a cylindrical roller pin 42.

FIG. 7 shows in enlarged detail the construction of T-shaped slots 122 having a central elongate slot, or passage 130 that extends completely through plate 36 and a pair of winged recesses, or pin slots 132 and 134 that form a support surface for opposed ends of each pin 42 (see FIG. 8). Each bore 51 is spaced within plate 36 in linear relation to a T-shaped slot 122.

As shown in FIG. 8, each yoke 38 includes a threaded horizontal bore 47 at one end and a pair of vertical bores 45 toward an opposite end. A cylindrical pin 42 is press fit into bores 43 on each of a pair of sidewalls, or legs 61 and 63 on each yoke 38. Each leg 61 and 63 also has a threaded vertical bore 45 sized to receive a respective one of the threaded set screws 44 for vertically adjusting height of each leg and setting a proper elevation of yoke 38 relative to bracket 36 (see FIG. 6). Roller 40 is received within slot, or groove 65 between each leg 61 and 63 for rotation about pin 42.

Figures 9, 10:
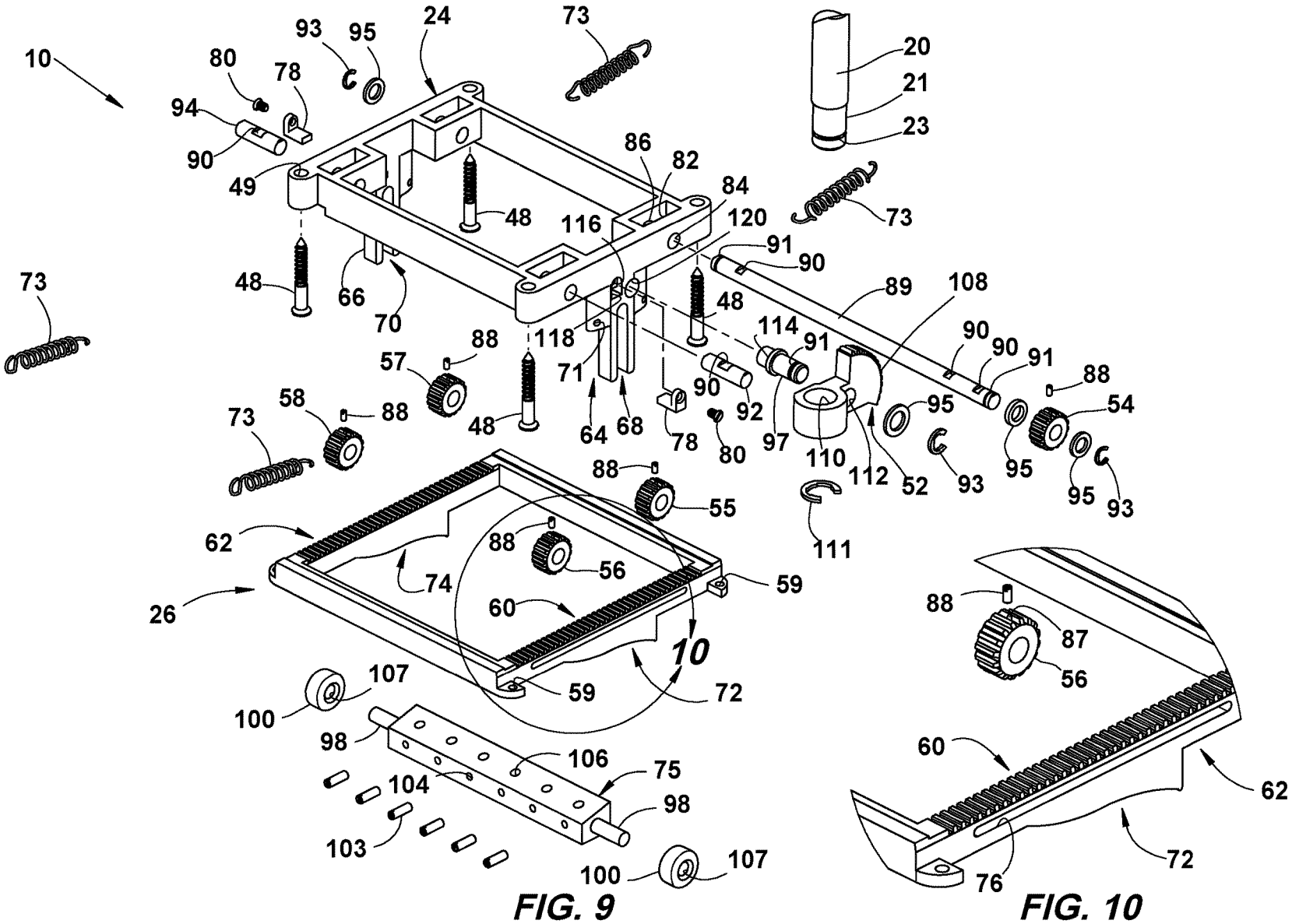
FIG. 9 is an exploded perspective view from above of the tremolo assembly of FIGS. 1-5.
FIG. 10 is an enlarged partial perspective view of a linear gear rack portion of the tremolo assembly taken from encircled region 10 of FIG. 9.
Figure 13:
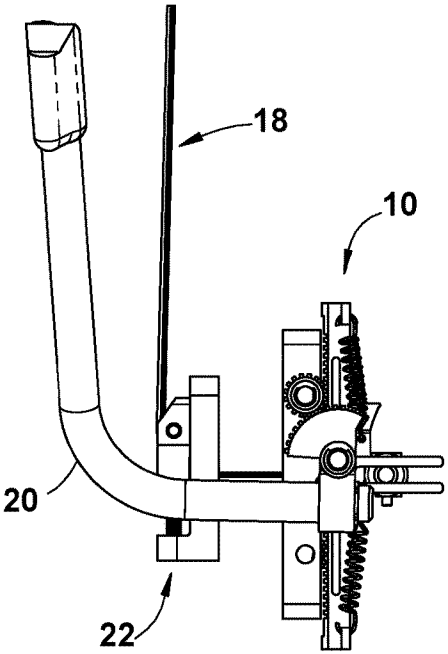
FIG. 13 is a right view the tremolo assembly and adjustable bridge of FIGS. 11-12.
Figure 12:
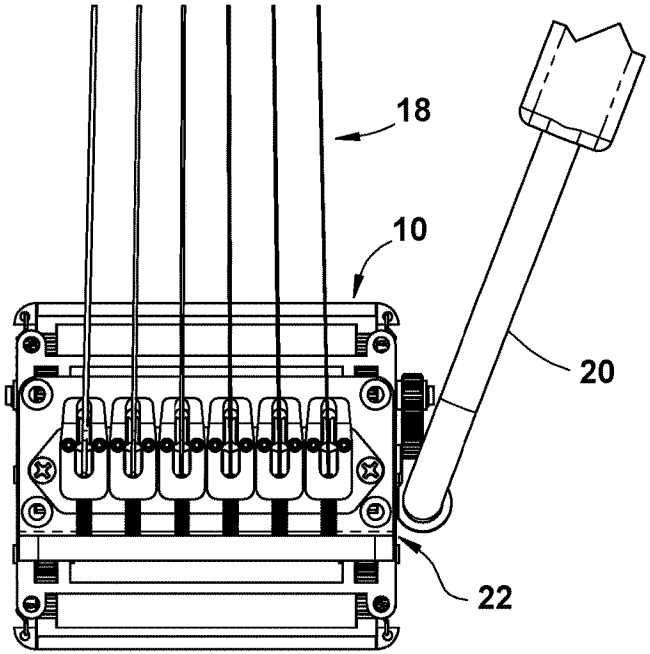
FIG. 12 is a top view of the tremolo assembly and adjustable bridge of FIG. 11.
Figure 11:
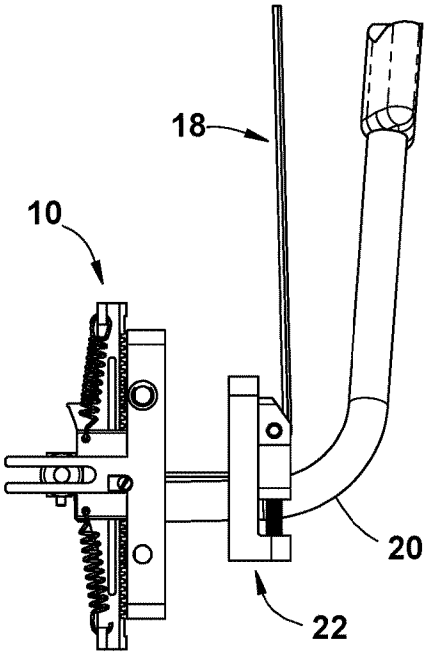
FIG. 11 is a left side view of the tremolo assembly and adjustable bridge as shown assembled together in FIG. 5 but with a guitar removed for viewing.
Figure 14:
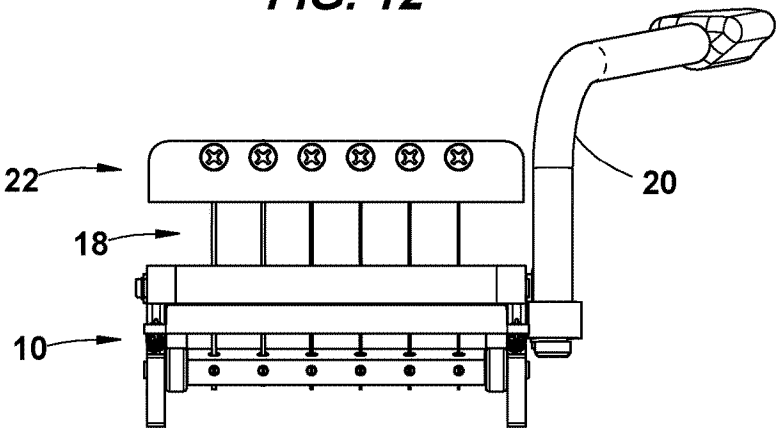
FIG. 14 is a front end view of the tremolo assembly and adjustable bridge of FIGS. 11-13.
Figure 15:
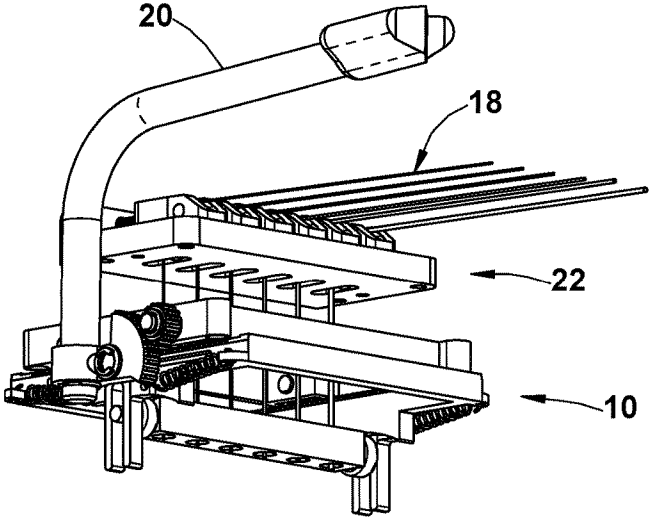
FIG. 15 is a perspective view from below and towards the neck end of the instrument, but with the guitar removed, of the tremolo assembly and the adjustable bridge.
Figure 16:
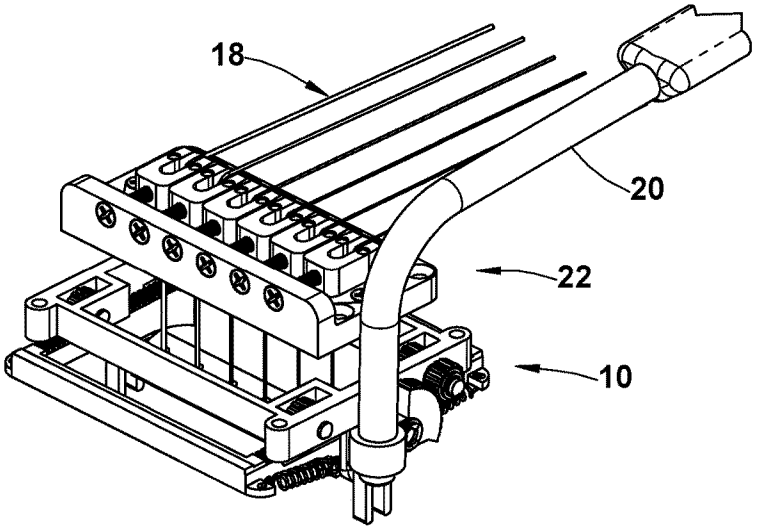
FIG. 16 is a perspective view from above and towards the body of the tremolo assembly and adjustable bridge as shown in FIG. 15.
Figure 17:
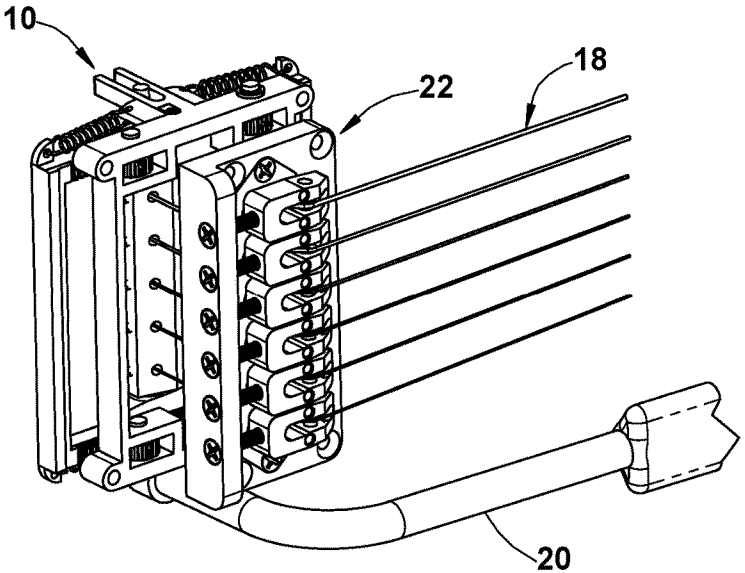
FIG. 17 is another perspective view from above and towards the body but rotated 90 degrees relative to the view in FIG. 16.
Figure 18:
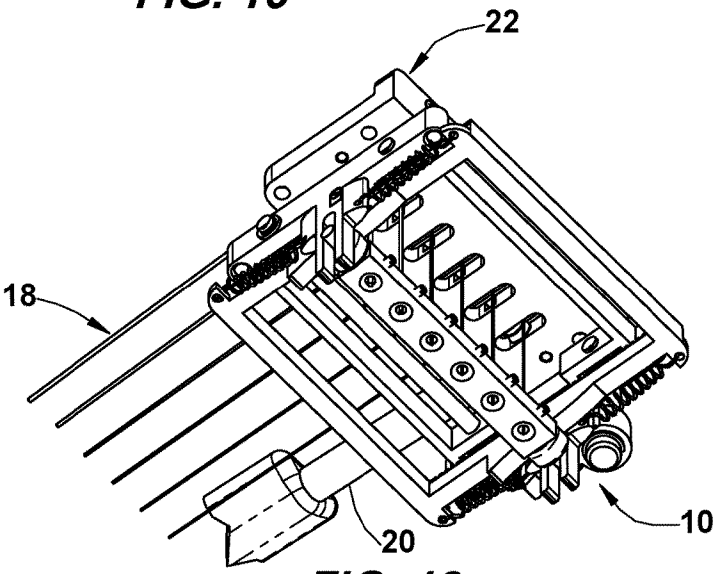
FIG. 18 is a perspective view from below of the tremolo assembly and adjustable bridge of FIGS. 15-18.

FIG. 9 illustrates in exploded perspective view from above construction of tremolo assembly 10. More particularly, sled 26 is driven in reciprocation along frame 24 in response to a user manipulating position of whammy bar 20. The lateral, or reciprocating motion of sled 26 results in motion of string bar 75 parallel to the direction of tension on strings 18 to various corresponding vertical positions via a pair of complex curve guide tracks 72 and 74 which support rollers 100 on each end of string bar 75 in rolling, or rotating contact. Posts 98 on string bar 75 are guided for vertical reciprocation within complementary vertical slots, or guide tracks 68 and 70 provided in fork members 64 and 66 in frame 24 as whammy bar 20 is manipulated by a user playing a guitar. Wheels 100 each have a central bore 107 (and a bearing raceway) that receives a terminal end of post 98 in press-fit. Terminal ends of each guitar string (not shown) pass through individual bores 106 in bar 75 and threaded set screws 103 secure such string within each bore 106 by being threaded into threaded lateral bores 104 in bar 75 to secure and entrap such strings.

A pair of linear gear tracks 60 and 62 are provided along spaced apart opposed sides of sled, or moving frame 26, as shown in FIG. 9. More particularly, rotating cylindrical gears 55, 56 and 57, 58 engage each of tracks 60 and 62, respectively, to guide sled 26 in parallel reciprocating motion relative to stationary base frame 24. Gears 54, 55 and 57 are affixed onto a metal drive shaft 89 using individual threaded set screws 88 that thread into radial threaded bores in each respective gear 54, 55 and 57 to engage a radial inward flat segment 90. Shaft 89 is supported at opposite ends by frame 24 within sets of bores, such as bores 84 and 86 provided on opposed sides of a gap or slot 82 in frame 24 configured to receive gear 55 in rotation. Outboard of bore 84 in frame 24, a pair of washers 95 are provided on opposed sides of gear 54 and a c-shaped spring clip 93 is affixed onto shaft 89 at each end over a reduced diameter slot, or groove 91, locking shaft 89 onto frame 24 for rotation. A single washer 95 is provided at an opposed end of shaft 89 outside of frame 24.

As shown in FIG. 9, gear 54 is driven in rotation when a cam gear body 52 is rotated via movement of whammy bar 20. Cam gear body includes an arcuate quadrant circular, cam gear face 108 that intermeshes with a complementary gear surface on gear 54. More particularly, gear body 52 includes a central pivot axis bore 112 and an offset receiving bore 110 sized to receive a reduced diameter shaft portion 21 on whammy bar 20. Shaft portion 21 is seated within bore 110 and a c-shaped spring clip 111 is affixed within a radially inward circumferential groove 23 on whammy bar 20 thereby affixing whammy bar 20 onto gear 52. A pivot pin 97 is press fit into a complementary cylindrical bore 120 in frame 24 up to an enlarged circumferential shoulder 114. A remaining distal portion of pin 97 is inserted into bore 112 of gear body 52 in a clearance fit to enable pivoting of gear body 52 about pin 97. A radial inward circumferential slot 91 adjacent a distal end of pin 91 is sized to receive a c-shaped spring clip 93 after a washer 95 is mounted over pin 91. Remaining gears 56 and 58 are each freely rotating follower gears while gears 55 and 57 serve as drive gears resulting from movement of whammy bar 20 to reciprocate sled 26 relative to stationary frame 24. Pins 92 and 94 are received for rotation into bores in frame 24 to entrap gears 55 and 57 for rotation thereabout. Each pin 92 and 94 has a flat surface 90 used to affix respective gear 55 and 57 using a respective threaded set screw 88 received in a complementary threaded radial bore (not shown) in each gear 56 and 58.

Stationary frame 24 is affixed with four spaced-apart threaded fasteners, or screws 48 through holes, or bores 49 and into a wooden guitar body (not shown) as seen in FIG. 9. A complementary recess finger through-bore, or recess 118 is provided on opposed sides of frame 24 configured to receive respective finger bars 78 that extend into slots 76 (see FIG. 10) of moving frame, or sled 26 and secure with a respective threaded fastener, or screw 80 into a threaded hole, or bore 116 within a portion of finger bar recess 118 of frame 24.

Sled, or moving frame 26 of FIG. 9 is positioned for reciprocation relative to stationary frame 24 at a central, flat location along tracks 72 and 74 by tensioned pairs of springs 73 placed on each end of frame 26. An outer end of each tensioned spring is affixed to an aperture 59 on frame 26 and an inner end of each tensioned spring is affixed to a respective aperture 71 on frame 26.

FIG. 10 illustrates in enlarged partial detail the compound shape of track 72 provided beneath linear gear track 62. Linear elongate slot 76 is provided in an outer surface above track 72 and beneath linear gear track 60 configured to receive a leg portion of finger bar 78 (see FIG. 9) in assembly for guiding linear reciprocation of the sled 26 relative to the frame 24 (see FIG. 9). Radially extending threaded bore 87 in gear 56 is configured to receive a complementary threaded set screw in order to affix gear 56 onto pin, or shaft 92 (see FIG. 9).

FIGS. 11-14 illustrate in left, top, front and right views, respectively, of tremolo assembly 10 and adjustable bridge 22 in relation to a set of individual strings 18 positioned as mounted to a guitar, but without the guitar. More particularly, the increase or decrease of the angle of whammy bar 20 in relation to top surface 15 tensions or slackens strings 18 via actuation of tremolo assembly 10 to impart tonal variations when strings 18 vibrate. Adjustable bridge 22 directs strings 18 in a desired elevational location above a guitar (not shown) and turns such strings 18 towards tremolo assembly 10. Tremolo assembly 10 is shown in a centered position without any force being applied to whammy bar 20 by a user.

FIGS. 15-18 show relative positions of tremolo assembly 10, adjustable bridge 22, whammy bar 20, and strings 18 as mounted to a guitar in various perspective views, but with the actual guitar not shown to facilitate viewing. Whammy bar 20 is shown in a "home" or centered position with tremolo assembly 10 likewise in a central "home" position.

Figure 19:
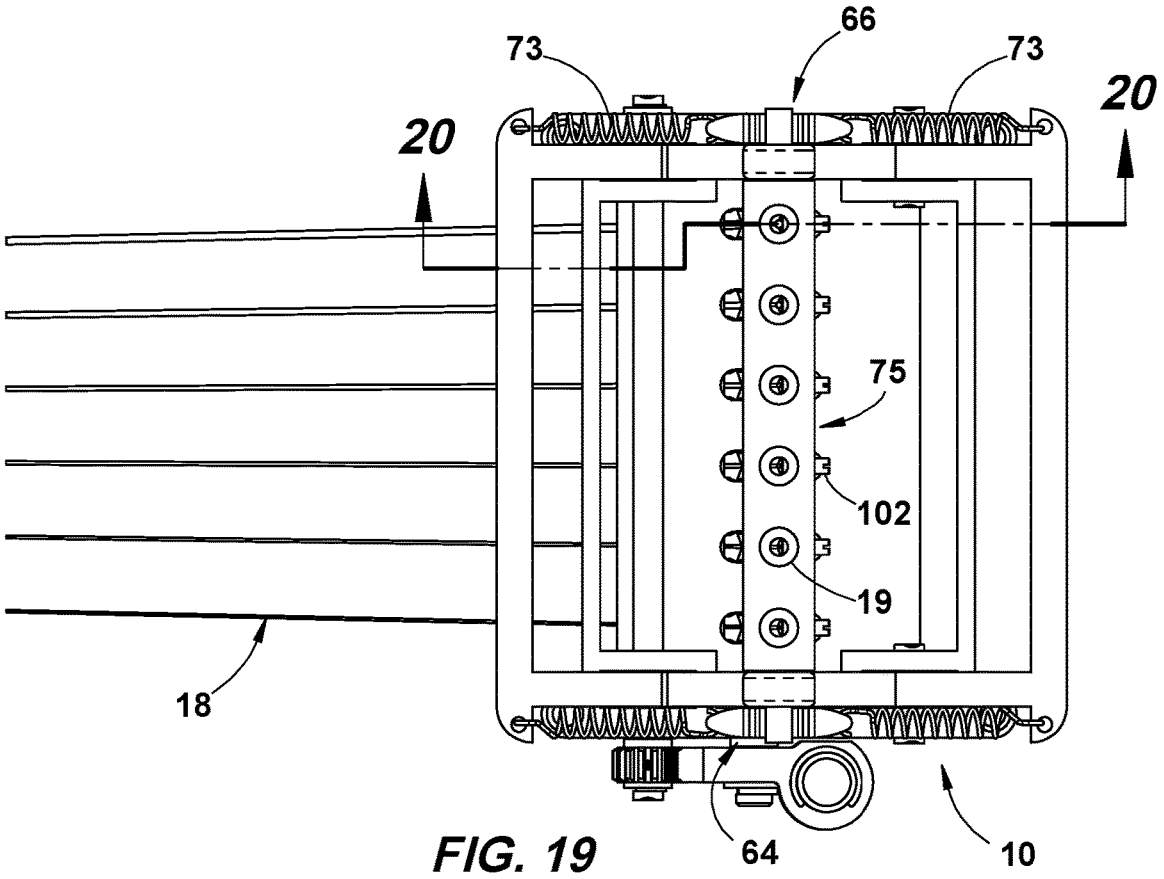
FIG. 19 is a plan view from below of the tremolo assembly and adjustable bridge of FIGS. 11-18 with the guitar removed to facilitate viewing as assembled together.

FIG. 19 is a plan view from underneath of tremolo assembly 10 and adjustable bridge (hidden) affixed to six strings 18 on a guitar (not shown). More particularly, strings 18 are each affixed at a terminal end with an individual swaged slug, or ball end 19 that is captured by string bar 75. Threaded set screw 102 further affixes the terminal end of each string 18 to string retainer bar 75. Bar 75 is guided for vertical reciprocation parallel to the orientation of the tension of strings 18 exerted on string bar 75 by forks 64 and 66 at opposed ends. Springs 73 are mounted under tension to center bar 75 at a central position relative to tremolo assembly 10.

Figure 20:
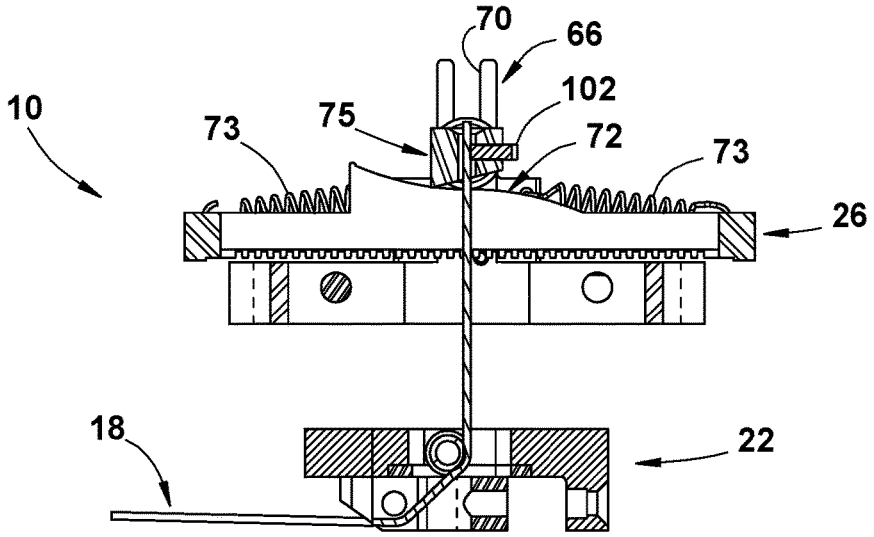
FIG. 20 is a vertical sectional view of the tremolo assembly and adjustable bridge taken along line 20-20 of FIG. 19.

FIG. 20 is a sectional view of tremolo assembly 10 and adjustable bridge 22 taken in vertical sectional view along line 20-20 of FIG. 19. More particularly, the spaced-apart relationship and alignment between tremolo assembly 10 (when mounted to a guitar body, not shown) is depicted showing the perpendicular change in direction taken as strings 18 are directed from bridge 22 to tremolo assembly 10. Actuation of a whammy bar (not shown) on tremolo assembly 10 causes bar 75 to raise tension or reduce tension on strings 18 as bar 75 is raised and/or lowered via movement of bar relative to location of varying height track 72. Springs 73 are tensioned to hold bar 75 at a stable, or flat central position along track 72. Fork 66 guides bar 75 in vertical reciprocation along straight track, or slot 70 as bar 75 is raised and lowered via movement of a whammy bar (not shown) and corresponding reciprocation of sled, or moving frame 26.

Figure 21:
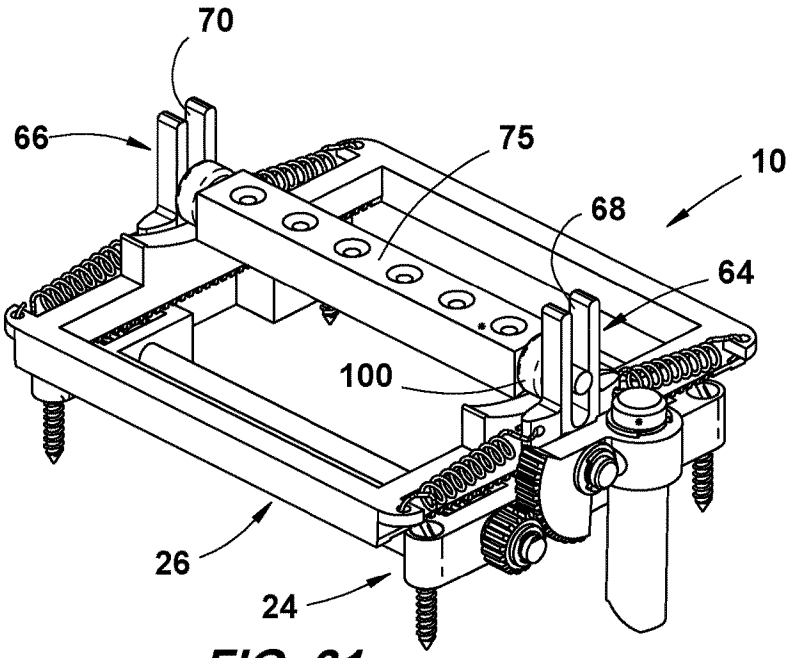
FIG. 21 is a perspective view from below of the tremolo assembly assembled together and seated in an intermediate, resting state.

FIG. 21 is a perspective view from below of tremolo assembly 10 further showing sled 26 in a centered, or home position relative to stationary frame 24.

Figure 22:
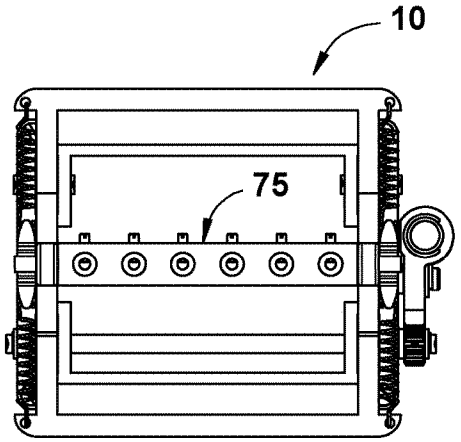
FIG. 22 is a plan view from below of the tremolo assembly of FIG. 21.

A bottom view of tremolo assembly 10 is shown in FIG. 22 further illustrating details of string bar 75 when supported in a central, stable position.

Figure 23:
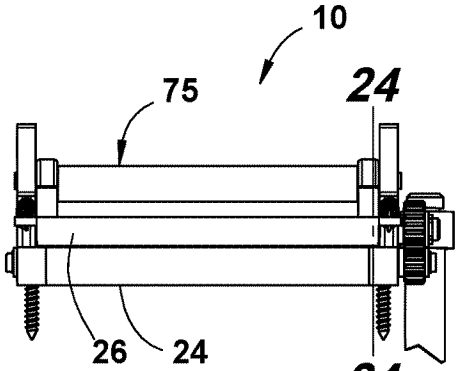
FIG. 23 is a front elevational view of the tremolo assembly of FIGS. 21-22.

FIG. 23 shows the relative positions of stationary frame 24 and moving frame 26. Movement of frame 26 relative to frame 24 imparts corresponding vertical reciprocation of string bar 75 which imparts axial tension and relaxation of respective guitar strings (not shown) affixed to string bar 75 in a manner that is substantially perpendicular with a sound board, or body of a guitar (not shown). Such orientation imparts a more substantial transfer of string vibrations into the guitar body to achieve a more desirable sound profile regardless of the oscillation between frames 24 and 26 that causes axial reciprocation of a vibrating string.

Figure 24:
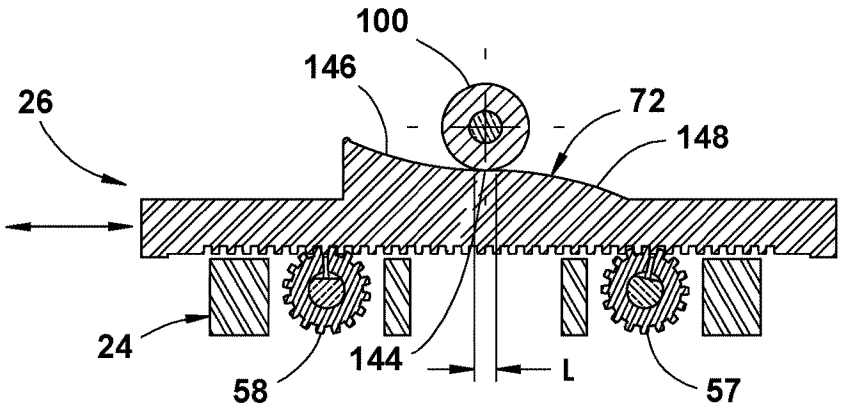
FIG. 24 is a vertical sectional view of the tremolo assembly of FIGS. 21-23 taken along line 24-24 of FIG. 23.

FIG. 24 illustrates in greater detail the manner in which a string bar 75 (see FIG. 21) is vertically reciprocated when moving frame 26 is oscillated, or reciprocated in linear movement relative to stationary frame 24 by a user manipulating a whammy bar 20 (see FIG. 16) to raise and lower wheel 100 on the string bar as wheel 100 is rolled along compound track surface 72 comprising a tensioning track surface 146, a string relaxation track surface 148, and a medial, or intermediate flat surface 144. Surface 144 has a nominal flat dimension designed as "L" where any minor lateral oscillation of frame 26 relative to frame 24 will not result in any lengthwise variation of guitar strings, such as might be caused by a string vibration while being played. Frame 26 is reciprocated when a user temporarily alters the angle of a whammy bar in relation to top surface 15 (not shown) and imparts corresponding rotation of round gears 57 and 58.

It is to be understood that while the embodiment of this invention shown and described is fully capable of achieving the objects and advantages desired, a number of modifications or variations could be made whilst achieving similar results. For instance, the sled and ramp may move rotationally on an axis perpendicular to the tension of the strings and thus move the mounting assembly via a cam-type actuation, the number of strings may be increased or decreased from a standard six, or the orientation of the sled and ramp relative to the base framework may be reversed in such a way that the pitch altering motions cause the opposite effect of those illustrated. These examples are not an exhaustive list of such changes and are not intended to outline all such possible dissimilarities, but to give an example of similar devices which follow the general spirit and method described herein. It is intended that the present invention encapsulates any such modifications or variations provided they follow the spirit of the invention. The particular embodiment shown has been for purposes of illustration only, and not for purposes of limitation.

In compliance with the statute, the subject matter disclosed herein has been described in language more or less specific as to structural and methodical features. It is to be understood, however, that the claims are not limited to the specific features shown and described, since the means herein disclosed comprise example embodiments. The claims are thus to be afforded full scope as literally worded, and to be appropriately interpreted in accordance with the doctrine of equivalents.

I claim:

1. A tremolo apparatus, comprising:

a stationary frame configured to be rigidly affixed to a planar surface of a resonant body on a stringed instrument;

a moving frame having at least one ramp with a medial flat segment, the moving frame guided for oscillation relative to the stationary frame;

at least one linear guideway extending substantially parallel to the planar surface and provided by at least one of the stationary frame and the moving frame and configured to guide the moving frame for oscillation;

a string retainer bar having a plurality of string capture bores carried by the guide frame for movement toward and away from the planar surface and configured to engage with the ramp surface to carry a plurality of strings substantially perpendicular with the planar surface to vary string tension as the string mounting assembly rides the ramp surface and reciprocates to respectively raise and lower tension of a plurality of strings carried terminally of the string mounting assembly; and at least one spring interposed between the stationary frame and the moving frame to position the string bar within the medial flat segment.

2. The tremolo apparatus of claim 1, wherein the stationary frame comprises a rectangular frame with a pair of parallel spaced apart linear guideways extending parallel to the planar surface configured to guide the moving frame to oscillate in axial reciprocation.

3. The tremolo apparatus of claim 2, wherein the moving frame comprises a plurality of round wheels fitted with each of the linear guideways to impart linear reciprocation between the stationary frame and the moving frame.

4. The tremolo apparatus of claim 3, wherein the linear guideways comprise a pair of parallel spaced-apart linear gear racks provided on one of the stationary frame and the moving frame and a pair of spaced-apart rotary gears provided on another of the stationary frame and the moving frame.

5. The tremolo apparatus of claim 4, wherein one of the rotary gears comprises a drive gear coupled with a whammy bar operative for a user to reciprocate the moving frame relative to the stationary frame.

6. The tremolo apparatus of claim 5, wherein the whammy bar is pivotally affixed to the stationary frame and coupled with the drive gear with a complementary arcuate gear.

7. The tremolo apparatus of claim 1, wherein the string bar includes a pair of opposed rollers, one roller pivotally supported at each end, and the moving frame has a pair of correspondingly spaced apart ramps each with a medial flat segment, each roller seated on the medial flat segment when in a resting position.

8. A tremolo apparatus, comprising:

a stationary frame configured to be rigidly affixed to a planar surface of a resonant body on a stringed instrument;

a moving frame having at least one ramp with a medial flat segment, the moving frame guided for reciprocation relative to the stationary frame;

a track extending substantially parallel to the planar surface and provided by at least one of the stationary frame and the moving frame and configured to support the moving frame for reciprocation relative to the stationary frame;

a string retainer bar configured to carry a plurality of strings on the guide frame for movement toward and away from the planar surface and configured to engage with the ramp surface to carry a plurality of strings substantially perpendicular with the planar surface to vary string tension as the string mounting assembly rides the ramp surface responsive to reciprocation to respectively raise and lower tension of a plurality of strings carried terminally of the string mounting assembly; and at least one spring interposed between the stationary frame and the moving frame to position the string bar within the medial flat segment.

9. The tremolo apparatus of claim 8, wherein the stationary frame includes a mounting surface complementary to the mounting surface of a stringed instrument comprising a planar mounting surface.

10. The tremolo apparatus of claim 8, wherein the moving frame comprises at least one spring configured to support the moving frame in sprung reciprocation about a central position.

11. The tremolo apparatus of claim 8, wherein the stationary frame comprises at least one vertical guide track configured to guide the string retainer bar toward and away from the mounting surface of a stringed instrument.

12. The tremolo apparatus of claim 8, wherein the string retainer bar comprises an elongate bar in which the plurality of string capture bores are provided in equally spaced-apart relation along the elongate bar.

13. The tremolo apparatus of claim 8, wherein the track comprises a linear gear rack and at least one round complementary gear.

14. The tremolo apparatus of claim 13, wherein a pair of linear tracks are provided in parallel spaced-apart relation on one of the stationary frame and the moving frame, and a plurality of complementary round gears are provided on another of the stationary frame and the moving frame configured to impart linear reciprocation between the stationary frame and the moving frame.

15. The tremolo apparatus of claim 14, wherein the moving frame comprises a pair of spaced-apart ramp surfaces and a correspondingly spaced-apart pair of roller bodies pivotally affixed to each opposed end of the string retainer bar with a guide pin extending therefrom configured to ride within a respective one of the pair of vertical guide tracks to constrain the moving string retainer bar to reciprocate toward and away from the mounting surface of a stringed instrument to tighten and loosen strings captured in each respective bore of the elongate bar.

16. The tremolo apparatus of claim 15, wherein the medial flat segment of each ramp surface is configured to stably support the string retainer bar with a stable mid-position string tension.

17. The tremolo apparatus of claim 16, wherein the moving frame comprises a pair of opposed springs configured in opposition and in tension to support the moving frame at a central stable position corresponding with the string retainer bar supported over each medial flat segment of each ramp surface under string tension in sprung reciprocation.

18. The tremolo apparatus of claim 17, further comprising an actuator arm gear mesh coupled with an arcuate gear with one of the rack and the rotary gears to impart reciprocation of the moving frame relative to the stationary frame.

19. The tremolo apparatus of claim 18, wherein the gear racks are on the moving frame, the rotary gears are on the stationary frame, and the actuator arm is a whammy bar coupled with a pivotal gear rack intermeshed with one of the rotary gears on the stationary frame.

20. A tremolo apparatus, comprising:

a moving frame having at least one ramp surface with a flat medial portion;

a stationary frame carried by a mounting surface of a stringed instrument body configured to support the moving frame for oscillation in substantially perpendicular relation with the direction of string tension;

an actuator arm coupled with the moving frame and carried by the stationary frame configured to drive the moving frame in oscillation with the stationary frame;

a string retainer bar provided by the stationary frame and configured to provide oscillatory movement of at least one string substantially along the direction of string tension, the moving frame configured to be driven in oscillation by a user relative to the stationary frame to respectively raise and lower tension of the at least one string affixed to the string retainer bar as the string retainer bar rides the ramp surface; and a resilient elongated member configured to position the flat medial portion of the ramp surface against the string retainer bar when in a resting state.

21. The tremolo apparatus of claim 20, further comprising a track provided by at least one of the moving frame and the stationary frame configured to support the moving frame for reciprocation relative to the stationary frame.

22. The tremolo apparatus of claim 21, wherein the track is a linear track and the moving frame reciprocates in linear motion relative to the stationary frame.

23. The tremolo apparatus of claim 21, wherein the resilient elongated member is a spring, and a pair of the springs are coupled in opposition between the moving frame and the stationary frame in tension to hold the flat medial portion against the string retainer bar when in a resting state.

* * * * *